US009243836B2

(12) United States Patent
Kim

(10) Patent No.: US 9,243,836 B2
(45) Date of Patent: Jan. 26, 2016

(54) HEAT INSULATION DOOR FOR A REFRIGERATOR HAVING 3 DIMENSIONAL SHAPES

(71) Applicant: LG Hausys, Ltd., Seoul (KR)

(72) Inventor: Yun Jung Kim, Seoul (KR)

(73) Assignee: LG HAUSYS, LTD., Seoul (KR)

( * ) Notice: Subject to any disclaimer, the term of this patent is extended or adjusted under 35 U.S.C. 154(b) by 0 days.

(21) Appl. No.: 14/369,463

(22) PCT Filed: Dec. 27, 2012

(86) PCT No.: PCT/KR2012/011594

§ 371 (c)(1),
(2) Date: Jun. 27, 2014

(87) PCT Pub. No.: WO2013/103214

PCT Pub. Date: Jul. 11, 2013

(65) Prior Publication Data

US 2014/0375200 A1 Dec. 25, 2014

(30) Foreign Application Priority Data

Jan. 6, 2012 (KR) ..... 10-2012-0001942
Jan. 6, 2012 (KR) ..... 20-2012-0000152 U

(51) Int. Cl.
*F25D 23/02* (2006.01)
*F25D 11/00* (2006.01)

(52) U.S. Cl.
CPC ..... *F25D 23/028* (2013.01); *F25D 11/00* (2013.01); *F25D 23/02* (2013.01); *F25D 2201/14* (2013.01); *F25D 2400/18* (2013.01)

(58) Field of Classification Search
CPC ..... F25D 23/02; F25D 23/028; F25D 21/00
USPC ..... 312/405
See application file for complete search history.

(56) References Cited

U.S. PATENT DOCUMENTS

2008/0143227 A1* 6/2008 Kim et al. ..... 312/405
2010/0242515 A1* 9/2010 Kim ..... 62/259.1

(Continued)

FOREIGN PATENT DOCUMENTS

DE 19757541 A1 7/1999
EP 1647758 A2 4/2006

(Continued)

OTHER PUBLICATIONS

International Search Report for PCT/KR2012/011594, mailed on Apr. 1, 2013, citing the above reference(s).

(Continued)

*Primary Examiner* — Daniel Rohrhoff
(74) *Attorney, Agent, or Firm* — Hauptman Ham, LLP

(57) ABSTRACT

A heat insulation door for a refrigerator able to realize 3 dimensional effects and with excellent heat insulation is presented.

A heat insulation door for a refrigerator having 3 dimensional shapes in accordance with the present invention comprises, an outer panel forming an outer surface of a door for a refrigerator that has 3 dimensional shapes, a groove type vacuum heat insulation material located inside the outer surface and having at least one groove, and a foamed vacuum insulation material filled inside, and has excellent 3 dimensional effects superior to printing effects, and has advantages of being able to secure excellent heat insulation properties.

7 Claims, 5 Drawing Sheets

(56) References Cited

U.S. PATENT DOCUMENTS

| | | | | |
|---|---|---|---|---|
| 2010/0295425 | A1* | 11/2010 | Kim | 312/204 |
| 2011/0095669 | A1* | 4/2011 | Moon et al. | 312/405 |
| 2011/0126578 | A1* | 6/2011 | Kim | 62/449 |
| 2012/0231204 | A1* | 9/2012 | Jeon et al. | 428/69 |
| 2013/0328472 | A1* | 12/2013 | Shim et al. | 312/405 |

FOREIGN PATENT DOCUMENTS

| | | | |
|---|---|---|---|
| JP | 2208480 | A | 8/1990 |
| JP | 0470992 | U | 6/1992 |
| JP | 06147740 | A | 5/1994 |
| JP | 2003065668 | A | 3/2003 |
| JP | 2007120795 | A | 5/2007 |
| JP | 2008121757 | A | 5/2008 |
| JP | 2009228917 | A | 10/2009 |
| JP | 2009287885 | A | 12/2009 |
| JP | 2010236558 | A | 10/2010 |
| KR | 20020019170 | A | 3/2002 |
| KR | 20090105245 | A | 10/2009 |
| KR | 20100126093 | A | 12/2010 |
| KR | 20110100440 | A | 9/2011 |
| WO | 9632605 | A1 | 10/1996 |
| WO | 2011108850 | A2 | 9/2011 |

OTHER PUBLICATIONS

LG Hausys, "Product and Technical Data of Metalon", Apr. 26, 2010, pp. 1-4.

European Search Report dated Sep. 7, 2015 in connection with the counterpart European Patent Application No. 12864451.5, citing the above reference(s).

* cited by examiner

HEAT INSULATION DOOR FOR A REFRIGERATOR HAVING 3 DIMENSIONAL SHAPES

CROSS REFERENCE TO RELATED APPLICATION

This application claims the priority of Korean Patent Application No. 10-2012-0001942 filed on Jan. 6, 2012 and Korean Utility Model Application No. 20-2012-0000152 filed on Jan. 6, 2012 in the Korean Patent and Trade Mark Office. Further, this application is the PCT application of International Application No. PCT/KR2012/011594 filed on Dec. 27, 2012, which is incorporated herein by reference in its entirety.

TECHNICAL FIELD

The present invention relates to a heat insulation door for a refrigerator, more particularly, a heat insulation door for a refrigerator having 3 dimensional shapes able to realize excellent 3 dimensional effects by having 3 dimensional shapes in outer exposed surfaces, and having excellent heat insulation performance being applied as a vacuum insulation materials.

BACKGROUND ART

Examining the structure of recent doors for a refrigerator, outer surface is all in a 2 dimensional flat surface shape, and filled with foamed heat insulation materials. Structures of doors for a refrigerator are presented in prior publications such as Korea laid-open patent 10-2002-0019170.

Outer surfaces of these structures of doors for a refrigerator are in a shape of a 2 dimensional flat surface and finishing work is done with glass materials. However, normal a refrigerator with 2 dimensional flat surface shaped outer surface doors lack realization of 3 dimensional shapes. To overcome this disadvantage, attempts to have 3 dimensional shapes for the door are active, but there are problems in difficulty in manufacturing with common technologies that use glass finishing materials, and also there are problems of requiring high costs.

And also, even when manufacturing a door for a refrigerator having 3 dimensional shapes, there are problems of what method to use to obtain heat insulation properties.

DISCLOSURE

Technical Problem

The present invention is to solve the problems described above, and an objective is to provide a heat insulation door for a refrigerator having 3 dimensional shapes that may substitute the conventional doors for a refrigerator having 2 dimensional flat surface outer surfaces.

Technical Solution

A heat insulation door for a refrigerator having 3 dimensional shapes in accordance with an embodiment of the present invention to achieve the objective, comprises an outer panel forming an outer surface of a door for a refrigerator that has 3 dimensional shapes, a groove type vacuum heat insulation material located inside of the outer surface having at least one groove, and a foamed heat insulation material filled inside.

Advantageous Effects

A heat insulation door for a refrigerator having 3 dimensional shapes in accordance with the present invention has an outer surface built in 3 dimensional shapes to have effects of getting able to realize 3 dimensional effects beyond printing effects. Also, a heat insulation door for a refrigerator having 3 dimensional shapes of the present invention has effects of getting able to secure excellent insulation performance by having a foamed heat insulation material filled inside and a vacuum heat insulation material be located to be installed inside the outer panel and having a groove shape.

BEST MODE

Figure 1:
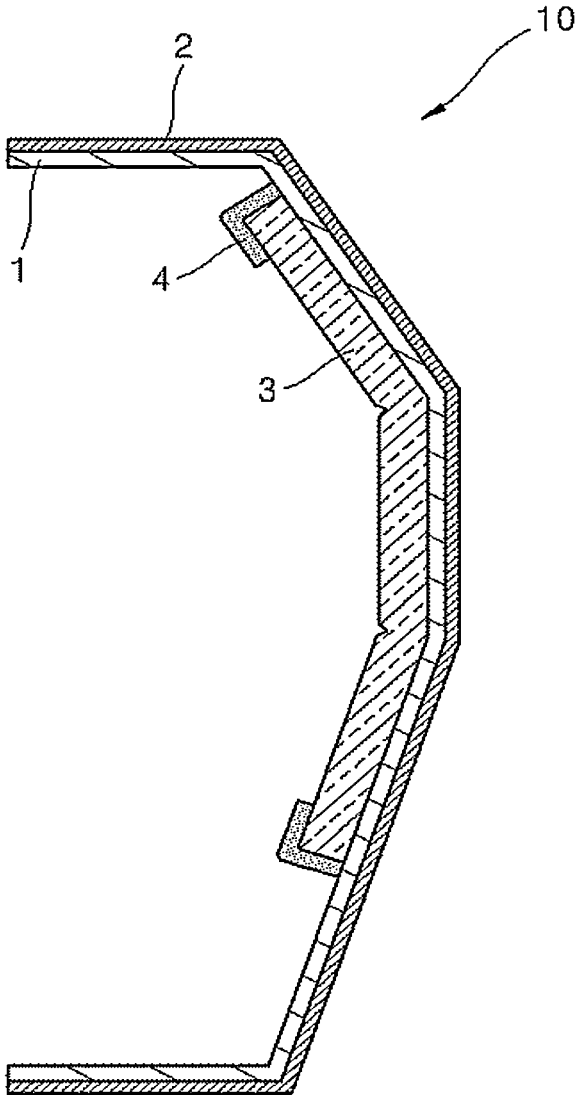
FIG. 1 is a cross sectional view showing an outline of a structure of a heat insulation door for a refrigerator having 3 dimensional shapes in accordance with an embodiment of the present invention.

Advantages and features of the present invention, and method for achieving thereof will be apparent with reference to the examples that follow. But, it should be understood that the present invention is not limited to the following examples and may be embodied in different ways, and that the examples are given to provide complete disclosure of the invention and to provide thorough understanding of the invention to those skilled in the art, and the scope of the invention is limited only by the accompanying claims and equivalents thereof. Like components will be denoted by like reference numerals throughout the specification.

Hereinafter, a heat insulation door for a refrigerator having 3 dimensional shapes in accordance with the present invention will be described in detail in reference to the accompanying drawings.

Heat Insulation Door for a Refrigerator Having 3 Dimensional Shapes

FIG. 1 is a cross sectional view showing an outline of a structure of a heat insulation door for a refrigerator having 3 dimensional shapes in accordance with an embodiment of the present invention.

Referring to FIG. 1, a heat insulation door (10) for a refrigerator in accordance with the present invention comprises an outer panel (1) having a 3 dimensional shape, a groove type vacuum heat insulation material (3) located inside of the outer surface and having at least one groove, and a foamed heat insulation material (not illustrated) filled inside.

A door for a refrigerator is illustrated in FIG. 1, and specifically an outer panel (1) part is illustrated in detail. A door for a refrigerator in accordance with the present invention is formed by combining an outer panel (1) exposed as an outer surface of a refrigerator and an inner panel (not illustrated) facing inside of a refrigerator, but it is not specifically limited with regards to shape and structure of an inner panel (not illustrated), or bonding types of the outer panel (1) with the inner panel (not illustrated), etc., and any design changes are possible based on what is known in the arts.

First, an outer panel (1), which is one component of a door for a refrigerator of the present invention, has a part, which forms an outer surface of a door for a refrigerator, having 3 dimensional shapes. An outer surface of a door for a refrigerator indicates a surface exposed to an exterior as a door in a completed product of a refrigerator. A conventional outer surface of a door for a refrigerator was all manufactured in a flat surface shape, and 3 dimensional effects were realized by printing patterns on an outer surface of such a flat surface shape. Whereas, a door for a refrigerator in accordance with the present invention is manufactured in a 3 dimensional shape by using a deep drawing method such as a pressing. FIG. 2 to FIG. 5 illustrates a front view, a side view, and an image of a refrigerator applied with a door for a refrigerator in accordance with the present invention. Referring to FIG. 2 to FIG. 5, it is shown that a door for a refrigerator in accordance with the present invention has an outer surface having 3 dimensional shapes, which is different from the conventional doors for a refrigerator.

The 3 dimensional shape formed on the outer surface of the door does not need to have a specific limited shape. However, to realize 3 dimensional effects by light and shadows, preferably, it may be 3 dimensional shapes with wedge shaped patterns formed repetitively, and the adjacent patterns among the patterns may form on different planes.

Figure 2:
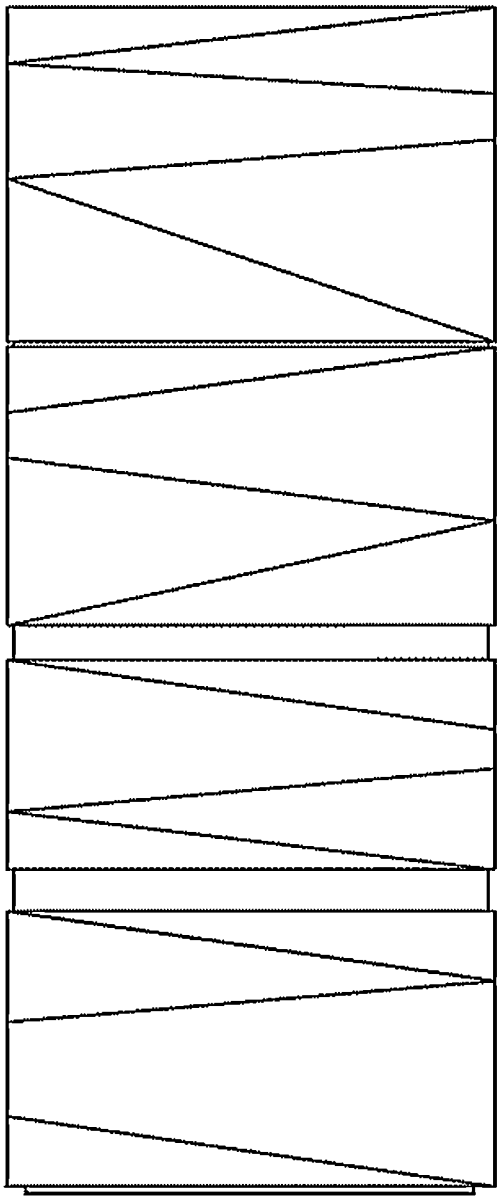
FIG. 2 is a front view of a refrigerator applying a heat insulation door for a refrigerator having 3 dimensional shapes in accordance with an embodiment of the present invention.
Figure 3:
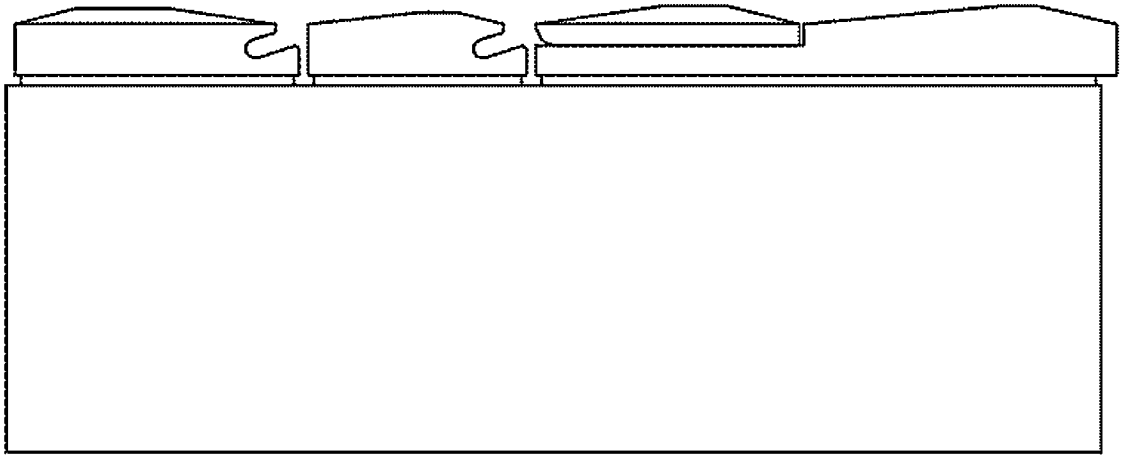
FIG. 3 is a side view of a refrigerator applying a heat insulation door for a refrigerator having 3 dimensional shapes in accordance with an embodiment of the present invention.
Figure 4:
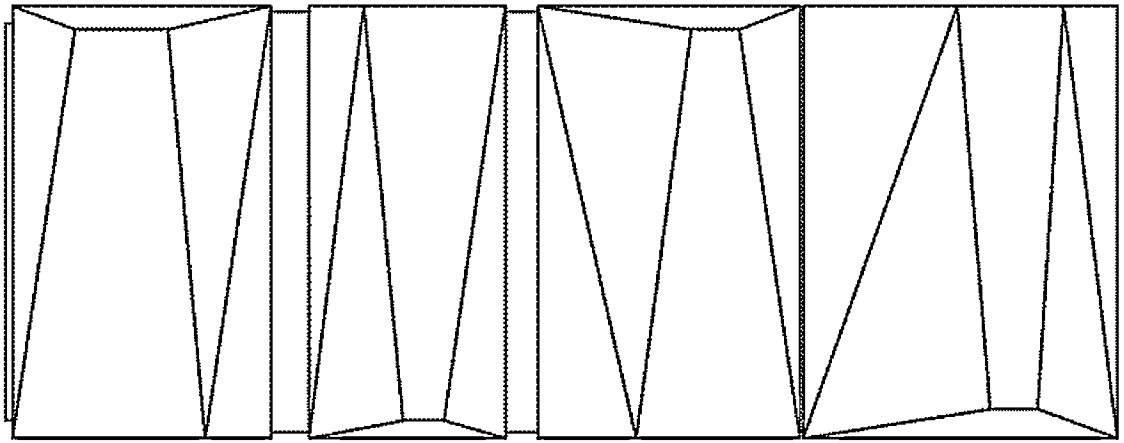
FIG. 4 is a front view of a refrigerator applying a heat insulation door for a refrigerator having 3 dimensional shapes in accordance with another embodiment of the present invention.
Figure 5:
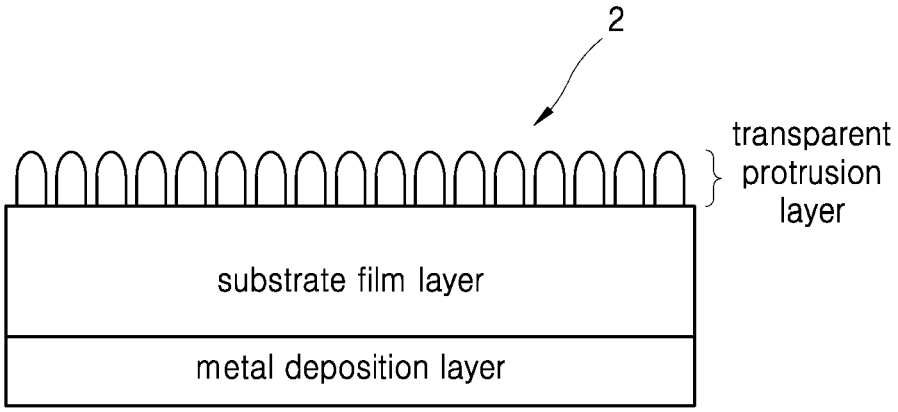
FIG. 5 is an image of a refrigerator applying a heat insulation door for a refrigerator having 3 dimensional shapes in accordance with another embodiment of the present invention.

Referring to FIG. 2 to FIG. 5, a wedge shaped pattern becoming narrower toward the left or the right is repeated on the outer surface of a door for a refrigerator, and adjacent patterns among these patterns are formed on different planes. That is, each pattern is formed in a 3 dimensional structure. And a heat insulation door for a refrigerator in accordance with the present invention, as illustrated in FIG. 2 and FIG. 3, may have 3 dimensional shapes with curvatures in a side view, and as illustrated in FIG. 4, it may have a 3 dimensional shape with curvatures formed in the middle part of the outer surface of the door.

Due to such a shape, a heat insulation door for a refrigerator in accordance with the present invention has very excellent 3 dimensional effects realization by light and shadows.

Next, a heat insulation door for a refrigerator in accordance with the present invention has a vacuum heat insulation material (3) for improving insulation properties, and the vacuum heat insulation material (3) has characteristics of a groove type having grooves in accordance with 3 dimensional shapes of an outer surface of a door. It is possible to apply a vacuum heat insulation material in a common flat surface shape for the outer surface of the conventional refrigerator because it has a flat surface, but it is hardly practicable to apply a flat surfaced vacuum heat insulation material for the door for a refrigerator having a 3 dimensional shape according to the present invention. Therefore, a vacuum heat insulation material (3) used in the present invention has grooves so as that it may fit into a 3 dimensional shape of the outer surface of the door for a refrigerator. Easy bending is possible through the groove of the vacuum heat insulation material. Methods for forming the groove are not specifically limited. The groove may be formed by pressing the manufactured vacuum heat insulation material with a jig, etc., but preferably, the groove type vacuum heat insulation material may be manufactured by manufacturing a core material with grooves, and then enclosing this with an outer cover material, being followed by depressurizing.

That is, the present invention, preferably, comprises glass fiber, and uses a vacuum heat insulation material (3) comprising a core material with one or more grooves and an outer cover material enclosing the core material and, then having been depressurized therein. The groove may be formed on the core material after manufacturing the core material, or may be formed after enclosing the core material with the outer cover material.

Here, there are no limitations for core materials if it comprises glass fiber, but it is preferable to be formed with materials comprised of one or more selected from silica board, glass board, and glass wool, and especially preferable to use a wet glass board made of glass fiber dried in 150° C. or below.

A core material in accordance with the present invention may use a piece of board comprised with the materials such as described above, or may be a laminate with several pieces of board comprised with the materials. It is preferable for the width of the groove to be twice or more than the thickness of a core material, and it is preferable for the end part of a cross section of a groove to be curved, and in this case, stress applied to an outer cover material may be minimized upon bending.

The outer cover material not only protects surfaces, the core material inside, etc. from outside shock, but also maintains the level of vacuum inside as a gas barrier, and plays a role of blocking outside gas or water, etc. from coming in.

When the outer cover material bends, the part that bends becomes elongated, and since oxygen and moisture penetrating that part increases and the level of vacuum inside the vacuum heat insulation material may degrade, it is preferable to use outer cover material laminated with dry lamination with multiple films.

Each multiple films comprising the outer cover material comprises, in order, an adhesive layer, a metal barrier layer formed on top of the adhesive layer, and a surface protection layer. In this instance, an adhesive layer is a layer formed inside a sealing member, and a surface protection layer may be defined as a layer exposed at the most outside. The heat insulation material in accordance with the present invention has a foamed heat insulation material (not illustrated) filled inside. The vacuum heat insulation material may use common vacuum heat insulation material known to the public such as rigid urethane. The foamed heat insulation material is formed by injecting undiluted solution inside and then foaming. That is, the door for a refrigerator in accordance with the present invention may secure excellent heat insulation properties from vacuum heat insulation material (3) having groove shapes and a foamed heat insulation material (not illustrated).

Also, the door for a refrigerator in accordance with the present invention may further comprise a fastening part (4) that fastens the vacuum heat insulation material (3) to an inside of an outer panel (1). A cross section of the fastening part (4) is made in an "L"-shape and may fasten the vacuum heat insulation material (3).

The fastening part is, preferably, formed with a plastic material, and especially, formed with a ductile plastic material and may fasten a vacuum heat insulation material.

Next, the door for a refrigerator in accordance with the present invention may attach a decoration film (2) on the outer surface. The decoration film (2) is attached to the outer surface of the door for a refrigerator and grants metallic textures, and also grants various patterns by means of glittering and metallic. That is, it is attached to an outer surface of an outer panel of the door for a refrigerator. It is preferable for the decoration film to be attached before press molding of the outer panel, but may be attached after press molding depending on the methods applied and needs for physical properties.

Any decoration films (2) may be used as being publicly known, which are able to show metal texture effects or various pattern granting effects by means of metallic texture or glittering and metallic material, iand, a decoration film optimized for outer surfaces having 3 dimensional shapes may be preferable used.

The decoration film (2) used preferably in the present invention may comprise a substrate film layer, a metal deposition print layer formed under the substrate film layer, and a transparent protrusion layer comprising multiple transparent protrusions, which are attached to the top of the substrate film layer being separated from each other.

Since the outer surface of the door for a refrigerator is formed with curvatures (straight lines and free curves) for 3 dimensional effects, there are concerns of degrading anti-finger printing when using the conventional decoration films. This is because minute protrusions on the curved surface, which may exhibit anti-finger printing inside the curvatures, may collapse. Therefore, it is preferable to use in the present invention, the decoration film having a transparent protrusion layer with each tiny protrusions attached separately and structured independently.

If it is a conventional substrate film used for decoration films, it may be used without special limitations for the substrate layer of the decoration film. Preferably, a transparent film or color film using polyester resin may be used.

A print layer of the decoration film is formed under the substrate film layer. However, the print layer is not required to be formed on a lower surface of a substrate layer in terms of structure of a decoration film. Other constituents may be comprised between the substrate film layer and a print layer. The print layer may be formed by deposition of metal to exhibit metal texture patterns. The transparent protrusion layer is made up of multiple transparent protrusions attached being separated from each other. The transparent protrusions are each individually structured, and attached to the top of the substrate film layer being separated from each other Here, the transparent protrusions being attached means that it is fastened to the top of the substrate film layer by adhesion or bonding, etc. Also, the transparent protrusions are not necessarily attached to the surface of the substrate film layer, and may be attached to a surface with a different constituent that may be formed on top of a substrate film layer. Each transparent protrusion is not formed as one body with a surface of a decoration film. The transparent protrusion may be, preferably, manufactured with curable polymer resin, etc. but is not limited thereto. Also, the shapes of transparent protrusions are not limited, and may be used by changing in a variety of ways in accordance with the sheet usage. The transparent protrusion (3) may comprise all protrusion shapes in the shape of a half sphere, star, diamond, trapezoid, triangle, and striped patterns.

As describe above, since the heat insulation door (10) for a refrigerator in accordance with the present invention comprises a outer panel (1) having the 3 dimensional shape, the groove type vacuum heat insulation material (3), and the foamed heat insulation material (not illustrated) filled inside, and may further comprise the decoration film (3) attached to the outer surface, not only does it have an excellent 3 dimensional effect superior to printing effects, has advantages of being able to secure excellent heat insulation properties.

Although detailed embodiments in accordance with the present invention have been described herein, these embodiments are given by way of illustration only, and it should be understood that various modifications, variations and alterations can be made by those skilled in the arts. Therefore, the scope of the present invention should be defined by the appended claims.

The invention claimed is:

1. A heat insulation door for a refrigerator having 3 dimensional shapes comprising:
- an outer panel forming an outer surface of a door for a refrigerator that has 3 dimensional shapes;
- a groove type vacuum heat insulation material located inside the outer surface and having at least one groove; and
- a foamed vacuum insulation material filled inside,
- wherein the vacuum heat insulation material comprises
  - a core material having a glass fiber and having one or more grooves, and
  - an outer cover material enclosing the core material and decompressed inside.

2. The heat insulation door for a refrigerator having 3 dimensional shapes according to claim 1, wherein the door further comprises a fastening part fastening the vacuum heat insulation material.

3. The heat insulation door for a refrigerator having 2 dimensional shapes according to claim 2, wherein the fastening part is made with a plastic material.

4. The heat insulation door for a refrigerator having 3 dimensional shapes according to claim 1, wherein the door further comprises a decoration film attached to the outer surface.

5. The heat insulation door for a refrigerator having 3 dimensional shapes according to claim 4, wherein the decoration film comprises,
- a substrate film layer,
- a metal deposition print layer formed under the substrate film layer, and
- a transparent protrusion layer constituted with multiple transparent protrusions, which are attached to the top of the substrate film layer being separated from each other.

6. A heat insulation door for a refrigerator having 3 dimensional shapes comprising:
- an outer panel forming an outer surface of a door for a refrigerator that has 3 dimensional shapes;
- a groove type vacuum heat insulation material located inside the outer surface and having at least one groove; and
- a foamed vacuum insulation material filled inside,
- wherein the door further comprises a decoration film attached to the outer surface, and
- wherein the decoration film comprises,
  - a substrate film layer,
  - a metal deposition print layer formed under the substrate film layer, and
  - a transparent protrusion layer constituted with multiple transparent protrusions, which are attached to the top of the substrate film layer being separated from each other.

7. A heat insulation door for a refrigerator having 3 dimensional shapes comprising:
- an outer panel forming an outer surface of a door for a refrigerator that has 3 dimensional shapes;
- a groove type vacuum heat insulation material located inside the outer surface and having at least one groove; and
- a foamed vacuum insulation material filled inside, wherein the outer surface is formed with repeated wedge patterns, and the adjacent patterns among the patterns are formed on different planes.

* * * * *